US005608920A

United States Patent [19]

Oliver et al.

[11] Patent Number: 5,608,920

[45] Date of Patent: Mar. 11, 1997

[54] DIVER'S FACE MASK WITH OFFSET PURGE VALVE

[75] Inventors: Bill N. Oliver, Dana Point; Peter Manno, La Jolla, both of Calif.

[73] Assignee: Sea Quest, Inc., Carlsbad, Calif.

[21] Appl. No.: 369,178

[22] Filed: Jan. 5, 1995

[51] Int. Cl.[6] ..... A61F 9/02

[52] U.S. Cl. ..... 2/428; 128/200.29; 128/201.28

[58] Field of Search ..... 2/428, 430, 429, 2/426; 128/200.29, 201.28

[56] References Cited

U.S. PATENT DOCUMENTS

| | | | |
|---|---|---|---|
| 3,671,976 | 6/1972 | Johnson et al. | 2/430 |
| 4,856,120 | 8/1989 | Hart | 2/428 |
| 5,231,982 | 8/1993 | Harrison et al. | 128/201.28 X |
| 5,329,643 | 7/1994 | Sato | 128/200.29 X |

*Primary Examiner*—Peter Nerbun

*Attorney, Agent, or Firm*—George F. Bethel; Patience K. Bethel

[57] ABSTRACT

A diver's face mask having a centrally offset purge valve which is easily purged by tilting the mask toward the purge valve to accumulate any water within the mask and exhaling through the nose.

15 Claims, 2 Drawing Sheets

DIVER'S FACE MASK WITH OFFSET PURGE VALVE

FIELD OF THE INVENTION

This invention relates to the field of face masks for use in diving and particularly to a diver's face mask having a centrally offset purge valve for purging accumulated water from the interior of the mask.

BACKGROUND OF THE INVENTION

In the course of scuba diving and snorkeling, small amounts of water seep or leak into a diver's face mask. This creates an annoyance since the water can obscure the diver's vision, or enter a diver's mouth or nose.

Face masks have been provided with a purge valve in front of the nose, mouth or chin for discharge of water by exhaling. Water escapes through a mushroom valve formed by a flexible elastomeric valve cover with an elongated valve stem extending through an aperture formed in a valve cover support. Upon vigorous exhaling, the flexible valve cover opens and the water is forced out of the mask along with the exhaled air.

The above face masks have been generally well received. However, the release of the air bubbles centrally of the face mask caused the visual field to be obscured by the rising bubbles. Since purging is required fairly often, this can be annoying. In some instances it can create a safety problem where accurate vision is particularly required as in welding and other underwater working activities.

In an effort to solve this problem, a deflector was provided to channel bubbles released during purging to either side of the mask to avoid bubbles in the central vision of the mask. Such a mask is the subject of U.S. Pat. No. 4,856,120.

The above described face mask, while a vast improvement over the central purge valve masks without the deflector, requires that the head be held level for accumulation of water in the central area of the mask. This is not always possible or convenient.

There remains a need for a diver's face mask which would be easily and effectively purged without obscuring the visual field during purging.

Another problem is that centrally oriented purge valves do not always gather water in the area to be purged. The diver's face mask of this invention allows the flow of water to an offset sump above the purge valve for improved gathering of water. This in part is accomplished by merely inclining the head of a diver to gather the water in the sump.

Thus, it is an object of the invention to provide a diver's face mask having a centrally offset purge valve which is easily purged by tilting the mask toward the purge valve to accumulate any water within the mask into a sump and exhaling to drive it out of the mask.

SUMMARY OF THE INVENTION

A diver's face mask is provided by the invention which includes a purge valve in the bottom left or right side of the mask in an area generally underlying the left or right eye lens. The purge valve is of the mushroom valve type which is preferably positioned in a small depression or sump for accumulation of water.

Purging is easily and conveniently effected by tilting the head of a diver toward the side of the mask containing the purge valve and exhaling. Tilting of the head causes the water to flow to the depression, sump or hollow in the mask containing the purge valve. Exhaling creates a pressure sufficient to cause the mushroom valve to open and the water and exhaled air or gas to be discharged through the valve.

During purging, the exhaled gas or air bubbles are offset with respect to the central vision. Thus, interference with vision is minimized. Also enhanced accumulation of water is obtained by the offset sump or hollow which can receive the drainage from the mask interior.

After purging, the natural resilience of the valve and the water pressure of the water keep the purge valve in the closed and sealed condition.

The invention will be more readily understood by reference to the drawings taken with the description which follows.

DETAILED DESCRIPTION OF THE DRAWINGS

Figure 1:
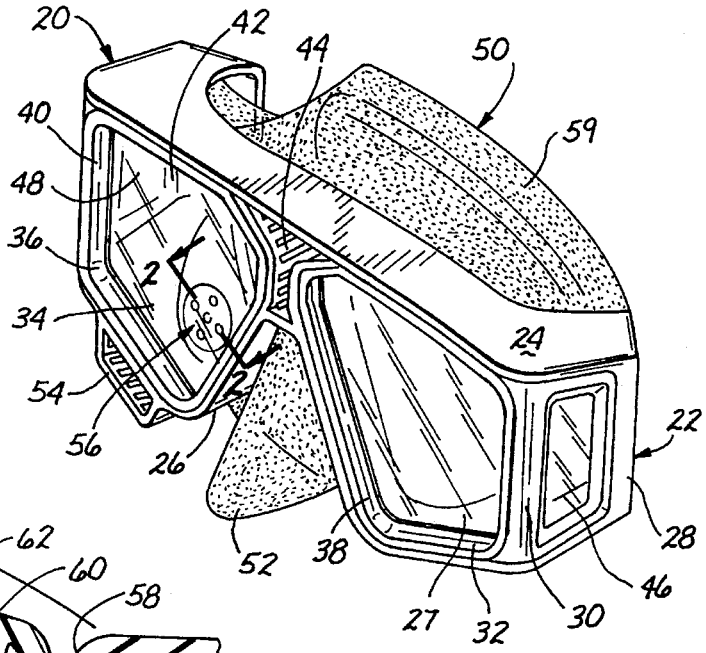
FIG. 1 shows a perspective view of the diver's face mask of the invention.

Referring now to FIG. 1 there is shown a perspective view of the diver's face mask 20 of the invention. In describing the mask, the terms "left" and "right" correspond to the left or right of a diver using the mask.

The mask 20 includes a relatively rigid support frame 22 having a top member 24 which extends across the top. Left outer side members 28 and 30, left bottom member 32 and inner nose support member 38 form the left side of the frame 22.

Similarly, right bottom member 36, with right outer side members 40 and 42, and right inner nose support member 26 form the right side of the frame 22.

An open channel or through passage is formed in a cupped lid channel member or fairing 54 attached to the right bottom member 36. The fairing or cupped lid 54 extends backwardly beyond the edge of member 36. The fairing or channel member 54 opens at the front of the frame 22 through a grill or slotted area 94. The rear of the fairing or channel member 54 is fully open. The fairing or cupped lid 54 consists of a bottom wall 55 and two side walls 57 and 61.

A bridge member 44 unites the left and right sides of the frame 22. A pair of keyed apertures 90 and 92 in the left and right sides of frame 22 can engage means not shown for attachment of strap members or other attachment means in order to hold the mask 20 in place on a diver's face. Other types of attachment means can be used which will be apparent to those skilled in the art.

The support frame 22 is preferably made of a relatively rigid plastic but a metal or other types of materials can also be used.

Within the right front of the frame 22 in the area enclosed by right side frame member 40, right bottom frame member 36, right inner nose frame member 26 and top frame member 24 is right front lens 34. Similarly, within the left front in the area enclosed by left side frame member 30, top frame member 24, left inner nose frame member 38, and left bottom member 32 is left front lens 27.

A left side lens 46 disposed between left side frame members 28 and 30, and a right side lens 48 disposed between right side frame members 40 and 42 provide peripheral vision to a diver.

A relatively soft, flexible, inner member generally indicated at 50 is adhered or sealed within the rigid frame 22. The inner member 50 includes a nose covering 52 and a peripheral skirt member 59 for close fitting, sealing contact with the face of a diver.

The inner member 50 is preferably made of a soft, flexible, slightly expandable plastic material which is impervious to sun, fresh and salt water exposure and which remains flexible at the temperatures of use.

Figure 2:
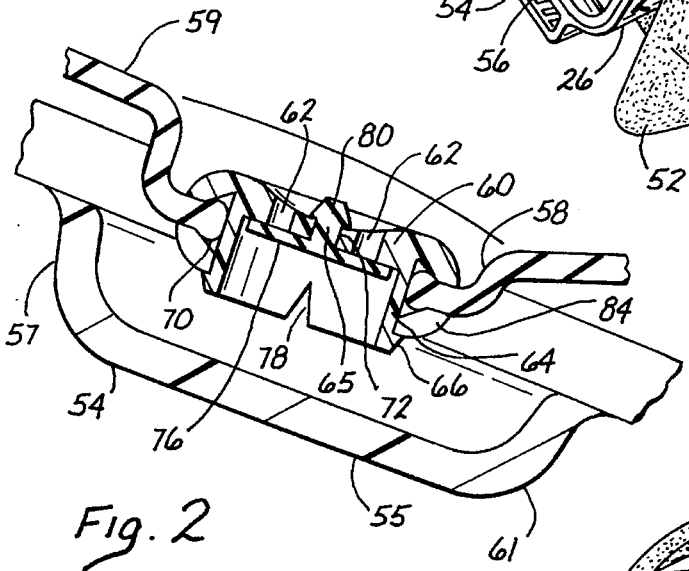
FIG. 2 shows a cross section taken along the lines 2—2 of FIG. 1 showing the purge valve in the closed condition.
Figure 4:
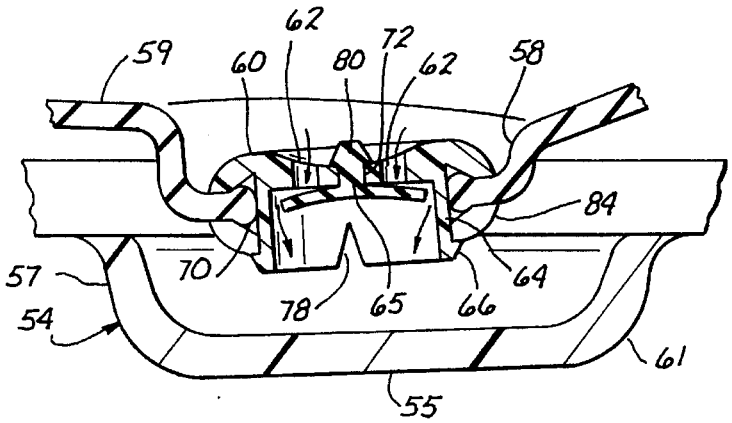
FIG. 4 shows the same cross section as that of FIG. 2 with the purge valve in the open condition.

The right bottom portion of peripheral skirt member 59 includes a purge valve 56 which is detailed in FIGS. 2 and 4. The purge valve 56 generally overlies the channel or passage in the fairing or cupped lid 54 of support frame 22. The purge valve 56 is positioned within a depression, cup or sump 58 formed within peripheral member 59. The depression or sump 58 permits the gathering or pooling of water therein when a diver tilts or angles his head toward the purge valve 56.

The purge valve 56 is formed by a disk-like valve member 60 having through openings, holes or passages 62 for the passage of water and a central opening 72. A circular flange 64 extends from the valve member 62. The circular flange 64 has a beveled edge 66 and one or more lengthwise slots 78 for ease of insertion within an opening or aperture 70 formed within peripheral skirt member 59. A ring 84 snaps from the exterior over the protruding circular flange 64 to hold the valve 56 in place within peripheral skirt member 59.

A flexible circular valve cover or membrane 76 having a valve stem 65 capped by a button or enlarged head 80 is seated against the openings 62 of valve member 60 within the circular flange 64. The stem 65 is inserted within central opening 72 of valve member 62 and is held in place by button or enlarged head 80.

In the showing of FIG. 2, the flexible membrane is held against and seals the openings 62 of disk-like member 60 keeping water out.

Figure 3:
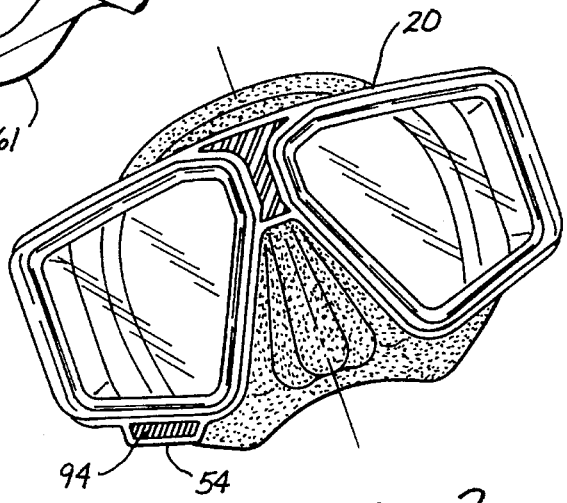
FIG. 3 shows an elevation view of the diver's face mask of the invention with one side of the mask tilted or angled toward the side containing the purge valve for discharge of accumulated water.

In order to purge the mask 20, it is tilted or angled toward the purge valve 56 as shown in FIG. 3. This causes any water within the mask 20 to accumulate or pool within the sump or depression 58.

Exhaling causes the valve 56 to open as shown in FIG. 4. Water and air exit valve 56 through openings 62 causing downward pressure against membrane 76. This moves the flexible membrane 56 away from the openings 62 allowing the air and water to escape therefrom and enter the open channel of the cupped lid or fairing 54 of frame 22.

Air bubbles escaping from the open channel of the fairing 54 flow upwardly at the side of the mask 20. Thus, the air bubbles do not obscure the central vision of the mask 20 as is the case with a centrally located purge valve.

Figure 5:
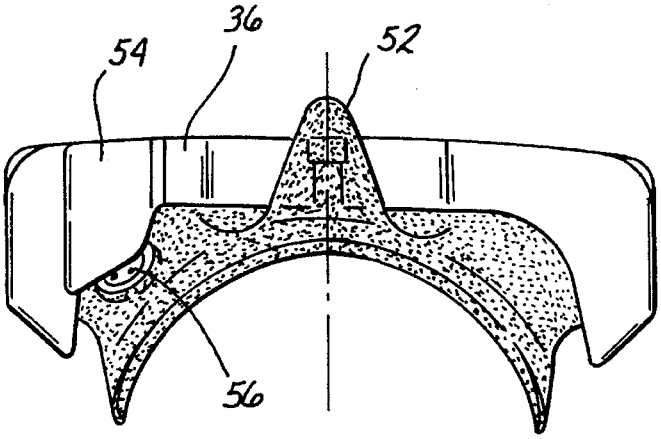
FIG. 5 shows a bottom plan view of the diver's face mask of the invention.
Figure 6:
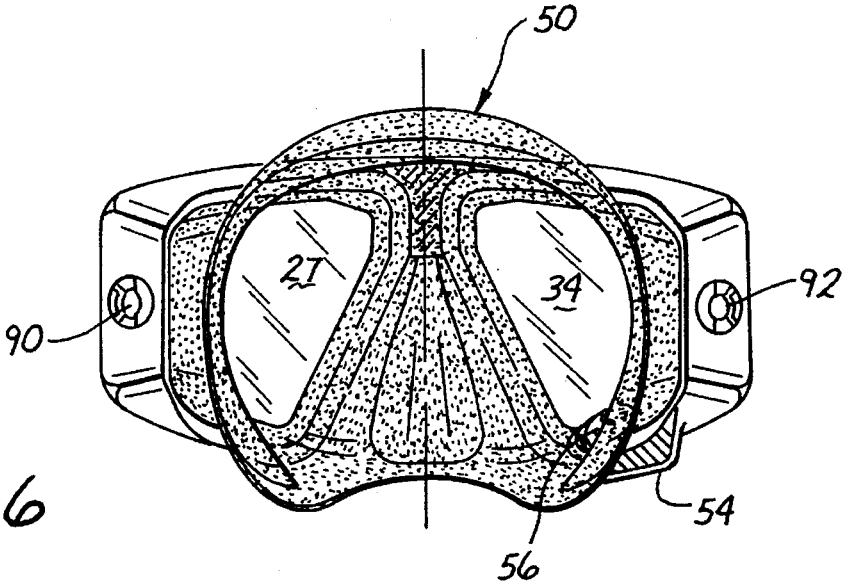
FIG. 6 shows a rear elevation view of the diver's face mask of the invention.

As shown in FIG. 5, the purge valve 56 opens into the channel of the fairing 54 in the right bottom member 36. The channel or passage in fairing 54 overlies the purge valve 56 to protect the valve 56 but does not interfere with its action. Water and air bubbles are free to escape from either end of the channel 54. The front grill or slotted area 94 acts to break up larger bubbles into smaller ones. This is an added feature of the invention.

The diver's face mask described provides an improved diver's face mask whereby a purge valve is centrally offset from the nose area. The purge valve is positioned at a bottom side of the mask so that air bubbles released during purging can travel to the side of the mask, leaving the frontal vision area substantially free and unobscured.

Of further consideration is that the water in the mask can be pooled or gathered more effectively in the sump, hollow or depression. This is easily done by merely tilting the diver's head in the direction of the sump or hollow. The result is a greater aggregate of water collected for purging in a minimal area. Thus, greater clearing of the mask of water at a centralized sump location is enhanced by this invention.

Various modifications of the invention are contemplated which will be obvious to those skilled in the art to which this invention pertains and can be resorted to without departing from the spirit and scope of the invention as defined in the claims which follow.

We claim:

1. A diver's face mask comprising:

a support frame defining an inner chamber having a top, left bottom, right bottom, left and right sides, and an upright front extending to the left and right of a central area adapted for enclosing the nose and eyes of a diver in a substantially fluid tight manner;

at least one transparent lens for viewing disposed within said frame; and, a purge valve connected to said frame and offset from said central area whereby water can be purged from the mask by tilting the mask toward the purge valve and exhaling through the nose;

a depression within said left or said right bottom of said mask for pooling of water; and, said purge valve being disposed within said depression.

2. A diver's face mask according to claim 1 wherein said purge valve is a mushroom valve.

3. A diver's face mask according to claim 1 wherein said purge valve comprises:

a disk-like valve support;

openings within said valve support for passage of air and water;

a flexible membrane in contact with said valve support and underlying said openings in sealing relationship; and, retaining means attached to said flexible membrane for retaining said membrane in contact with said valve support whereby upon exhalation through the nose, air and water are forced through said openings causing said flexible membrane to flex away from said openings followed by recontact with said openings.

4. A diver's face mask according to claim 3 wherein said purge valve further comprises:

a circular flange attached to the edges of said disk member and extending downwardly therefrom.

5. A diver's face mask according to claim 1 wherein said mask is formed of at least one plastic material.

6. A diver's face mask comprising:

a support frame generally outlining the eye and nose area of a diver;

at least one transparent lens held within said frame for viewing;

a rearwardly extending inner skirt having a top, bottom, and sides sealed to said support frame;

said inner skirt adapted for and made of a material for sealing contact with the facial skin of a diver;

said frame and said skirt defining an inner chamber;

a purge valve disposed within a bottom side of said inner skirt whereby upon angling of the head of a diver toward the purge valve and exhaling through the nose, air and water can be discharged through said purge valve; and, a depression within the bottom of said inner skirt for pooling of water and wherein said purge valve is disposed within said depression.

7. A diver's face mask according to claim 6 wherein said inner skirt further comprises:

a nose covering portion and wherein said purge valve is offset from said nose covering portion.

8. A diver's face mask according to claim 7 further comprising:

a fairing having an open channel at least partially underlying said purge valve and having means therein to break up air bubbles released therein.

9. A diver's face mask according to claim 8 wherein said purge valve is a mushroom valve.

10. A diver's face mask according to claim 7 wherein said purge valve comprises:

a disk-like valve support;

openings within said valve support for passage of air and water;

a flexible membrane in contact with said valve support and underlying said openings in sealing relationship; and, retaining means attached to said flexible membrane for retaining said membrane in contact with said valve support whereby upon exhalation through the nose, air and water are forced through said openings causing said flexible membrane to flex away from said openings followed by recontact with said openings.

11. A diver's face mask according to claim 10 wherein said purge valve further comprises:

a circular flange attached to the edges of said disk member and extending downwardly therefrom.

12. A diver's face mask according to claim 10 wherein said mask is formed of at least one plastic material.

13. In a diver's face mask including a frame member having a top, left bottom, right bottom and sides with at least one viewing lens forming an enclosure for covering the nose and eyes of a diver and having a purge valve, the improvement which comprises positioning the purge valve in a depression within said left bottom or said right bottom of said mask for pooling of water so that said purge valve is centrally offset from the region covering the nose.

14. A diver s face mask according to claim 13 wherein said mask is formed of at least one plastic material.

15. A diver's face mask according to claim 13 wherein said purge valve is a mushroom valve.

* * * * *